US005950863A

United States Patent [19]

Schutz et al.

[11] Patent Number: 5,950,863

[45] Date of Patent: Sep. 14, 1999

[54] SHEET DISPENSER INSERT

[75] Inventors: Rudolph W. Schutz, Fort Bragg; Niko A. Cvjetkovic, Santa Fe Springs, both of Calif.; Michel Morand, Montreal, Canada; Patrick C. Perrin, Rancho Palos Verdes, Calif.

[73] Assignee: Perrin Manufacturing, City of Industry, Calif.

[21] Appl. No.: 08/906,515

[22] Filed: Aug. 5, 1997

[51] Int. Cl.[6] ..... B65H 1/00

[52] U.S. Cl. ..... 221/46; 221/48; 221/63; 221/197

[58] Field of Search ..... 221/45, 46, 48, 221/62, 63, 197, 287; 312/50, 60

[56] References Cited

U.S. PATENT DOCUMENTS

| | | | |
|---|---|---|---|
| 1,217,682 | 2/1917 | Baldwin | 221/46 |
| 1,546,807 | 7/1925 | Straubel | 221/48 |
| 1,577,094 | 3/1926 | Arms | 221/48 |
| 1,724,428 | 8/1929 | Sherman | 221/46 |
| 1,883,008 | 10/1932 | Sherman | 221/46 |
| 2,426,787 | 9/1947 | O'Neil | 221/45 |
| 2,830,728 | 4/1958 | Krueger et al. | 221/48 |
| 4,678,099 | 7/1987 | Matsui | 221/48 |
| 5,642,836 | 7/1997 | Merriweather | 221/33 |
| 5,642,837 | 7/1997 | Hayes et al. | 221/197 |

*Primary Examiner*—H. Grant Skaggs
*Attorney, Agent, or Firm*—Sheldon & Mak

[57] ABSTRACT

An insert device for a sheet dispenser having a housing for receiving a stack of folded sheets, a bottom opening of the housing being formed as a rounded elongate slot having an enlarged center portion, includes a rear panel portion; an upwardly and forwardly sloping front ramp portion, a pair of side panel portions connecting the front ramp potion to the rear panel portion; and a ledge portion extending forwardly from the panel portion toward the ramp portion. Also disclosed is a method for bottom loading of the insert device (with stacked sheets therein) into a dispenser having door members defining a bottom opening thereof.

25 Claims, 6 Drawing Sheets

SHEET DISPENSER INSERT

BACKGROUND

The present invention relates to sheet dispensers, and more particularly to dispensers for folded and stacked sheets such as paper towels and the like.

Paper towel dispensers of the type wherein folded sheets are taken from the bottom of a stack by pulling from a bottom dispenser opening are well known. Single-fold, C-fold, and multi-fold configurations of the sheets have been commonly used. Multi-fold towels have been introduced recently with towel materials having enhanced softness and absorption; however, these towels have significantly reduced strength. Consequently, the softer high-absorbency multi-fold sheets are unsuitable for use in many existing dispensers, in that the multiple folds have relatively high resistance to being drawn through the bottom opening of the dispenser, being particularly subject to tearing, especially when grasped by wet fingers. Although some dispensers have been developed for feeding the high absorption multi-fold sheets, widespread acceptance of them is hindered by the high cost of replacing large numbers of existing dispensers, particularly those in permanently installed stainless steel cabinets.

A further problem with all dispensers is that rather than being fed as single sheets, clumps of the sheets are likely to fall through the bottom opening, particularly as the supply approaches exhaustion.

Thus there is a need for a way to reliably feed the soft, high absorbency multi-fold sheets in existing dispensers, including those made for single-fold and C-fold sheets. There is a further need for reliably feeding single-fold and C-fold sheets from dispensers that can also feed the multi-fold sheets.

SUMMARY

The present invention meets these needs by providing an adapter insert for existing single-fold/C-fold dispensers in which a housing has a bottom opening that is formed as a rounded elongate slot having an enlarged center portion. In one aspect of the invention, the adapter insert device includes, a rear panel portion; a front ramp portion; a pair of side panel portions connecting opposite ends of the front ramp portion and corresponding lower side edge portions of the rear panel portion; and a ledge portion extending forwardly from the panel portion toward and spaced from the ramp portion, the device being formed for placement in the dispenser with the side panel portions extending above and proximate opposite ends of the bottom opening, portions of the ramp and ledge portions extending in vertically spaced relation over opposite sides of the enlarged center portion of the opening, the sheets being dispensed by being withdrawn between the ramp portion and the ledge portion and through the bottom opening.

The device can further include a downwardly projecting leg portion that extends vertically below the ramp and ledge portions for engaging the bottom opening of the housing for registration of the device forwardly and/or rearwardly relative to the opening. The leg portion can project from one of the side panel portions for engaging the opening proximate an end extremity thereof. Preferably the leg portion is one of a spaced pair of the leg portions for engaging opposite locations of the opening. The leg portions can extend from corresponding ones of the side panel portions for engaging the opening proximate opposite end extremities thereof. The device can further include an adhesive member affixed to a rear surface of the panel portion for holding an upper extremity of the panel portion proximate an inside surface of the dispenser.

The ledge member can slope downwardly and forwardly from the rear panel portion. The ledge member can slope at an angle of approximately 94 degrees from the rear panel portion. The ledge member can project to a distance C from the rear panel portion, the front ramp portion having an inner extremity that is spaced forwardly of the ledge member by a distance G, the distance G being approximately equal to the distance C. The inner extremity of the ramp portion can be spaced below an upper surface of the ledge member by a distance F, the distance F being between approximately 10 percent and 30 percent of the distance G. Preferably the distance F is approximately 13.5 percent of the distance G. The ramp portion can slope upwardly and forwardly from the inner extremity at an angle β from a normal reference to the rear panel portion, the angle β being from approximately 50 degrees to approximately 60 degrees. Preferably the angle β is approximately 54.5 degrees.

In another aspect of the invention, an insert device for a sheet dispenser having a housing for receiving a stack of folded sheets, the housing having a bottom opening that is formed as a rounded elongate slot having an enlarged center portion, includes a rear panel portion; a front ramp portion, the ramp portion sloping upwardly and forwardly from an inner extremity thereof; a pair of side panel portions connecting opposite ends of the front ramp portion and corresponding lower side edge portions of the rear panel portion; and a ledge portion extending forwardly from the panel portion toward the ramp portion. The sheet dispenser can have a forwardly biased spring member within the housing, a spacer being compressively located between a front surface of the insert device and an interior surface of the housing, the spacer in combination with the device rearwardly displacing the spring member for locating a forward extremity of the ledge portion and a rearward extremity of the ramp portion approximately centered over the elongate slot. Alternatively, a registration member of the device can rigidly project into the opening and engaging same for rearwardly displacing the spring member to locate a forward extremity of the ledge portion and a rearward extremity of the ramp portion approximately centered over the elongate slot.

In a further aspect of the invention, a method for feeding multifold towel sheets from an existing dispenser having a housing, a bottom opening in the housing being a rounded elongate slot having an enlarged center portion, the existing dispenser being adapted for feeding single-fold and/or C-fold sheets, includes the steps of:

(a) providing an insert device having a rear panel portion, a front ramp portion that slopes upwardly and forwardly from an inner extremity thereof, a pair of side panel portions that connect opposite ends of the front ramp portion to corresponding lower side edge portions of the rear panel portion, and a ledge portion extending forwardly from the panel portion toward the ramp portion;

(b) inserting the device into the housing with the ramp portion and the ledge portion extending over opposite sides of the enlarged center portion of the bottom opening;

(c) loading a stack of multi-folded sheets into the device with the stack being supported on the ramp portion and the ledge portion; and (d) pulling sheets downwardly from between the ramp portion and the ledge portion and through the bottom opening.

The step of inserting the device can include the further step of interposing a spacer between a front surface of the device and an interior surface of the housing thereby to displace the device sufficiently rearwardly for alignment with the bottom opening of the dispenser. Alternatively, the step of inserting the device can include the further step of engaging a registration member of the device with the opening of the housing thereby to locate the device with a forward extremity of the ledge portion and a rearward extremity of the ramp portion approximately centered over the elongate slot of the dispenser.

Front and rear portions of the bottom opening of the dispenser can be defined by respective front and rear door members in respective closed positions thereof, the door members being pivotable upwardly within the housing for receiving the stack of multi-folded sheets from below the housing, the step of inserting the device including the further steps of:

(a) fastening one of the door members in an open position facing proximate a vertical interior surface of the housing;

(b) holding the other of the door members in an open position facing proximate another interior surface of the housing;

(c) feeding the device between the door members and into the housing;

(d) moving the other of the door members to the closed position thereof; and (e) moving the device within the housing into supportive engagement by the other of the door members, wherein the loading step precedes the feeding step.

DRAWINGS

These and other features, aspects, and advantages of the present invention will become better understood with reference to the following description, appended claims, and accompanying drawings, where:

DESCRIPTION

Figure 1:
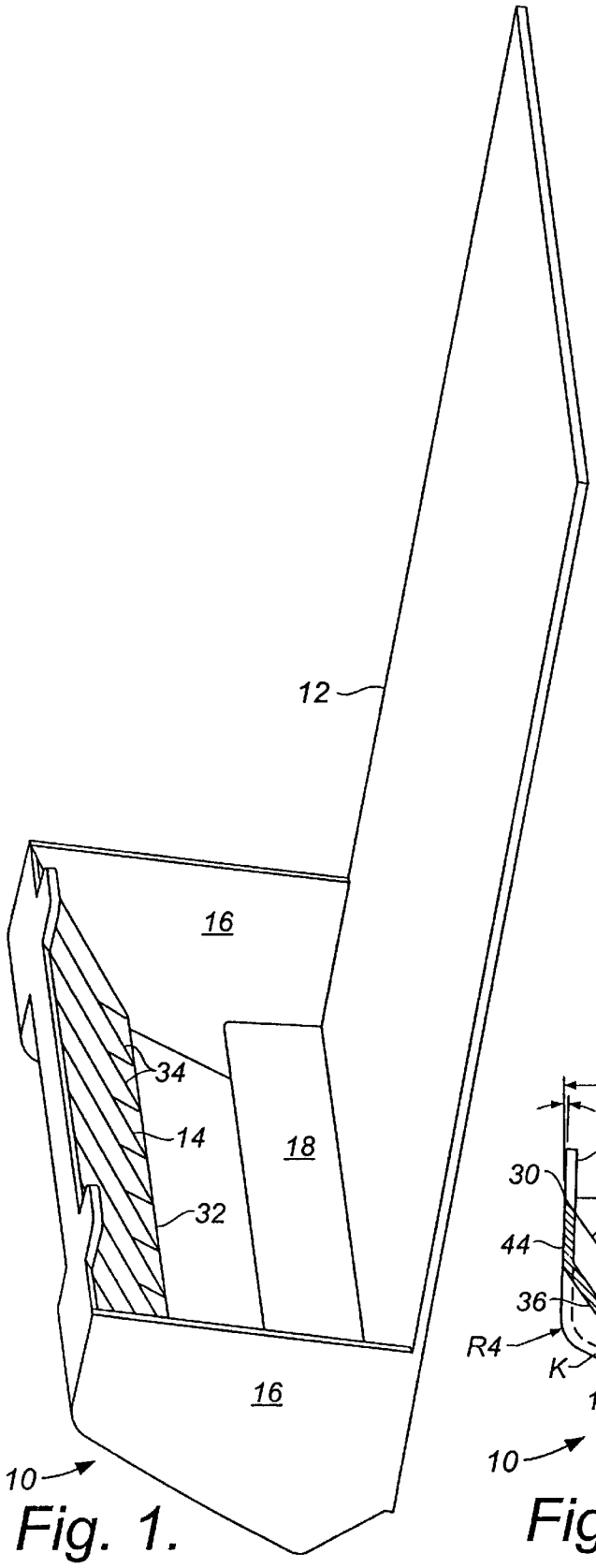
FIG. 1 is a perspective view of a sheet feeder adapter insert according to the present invention.
Figure 3:
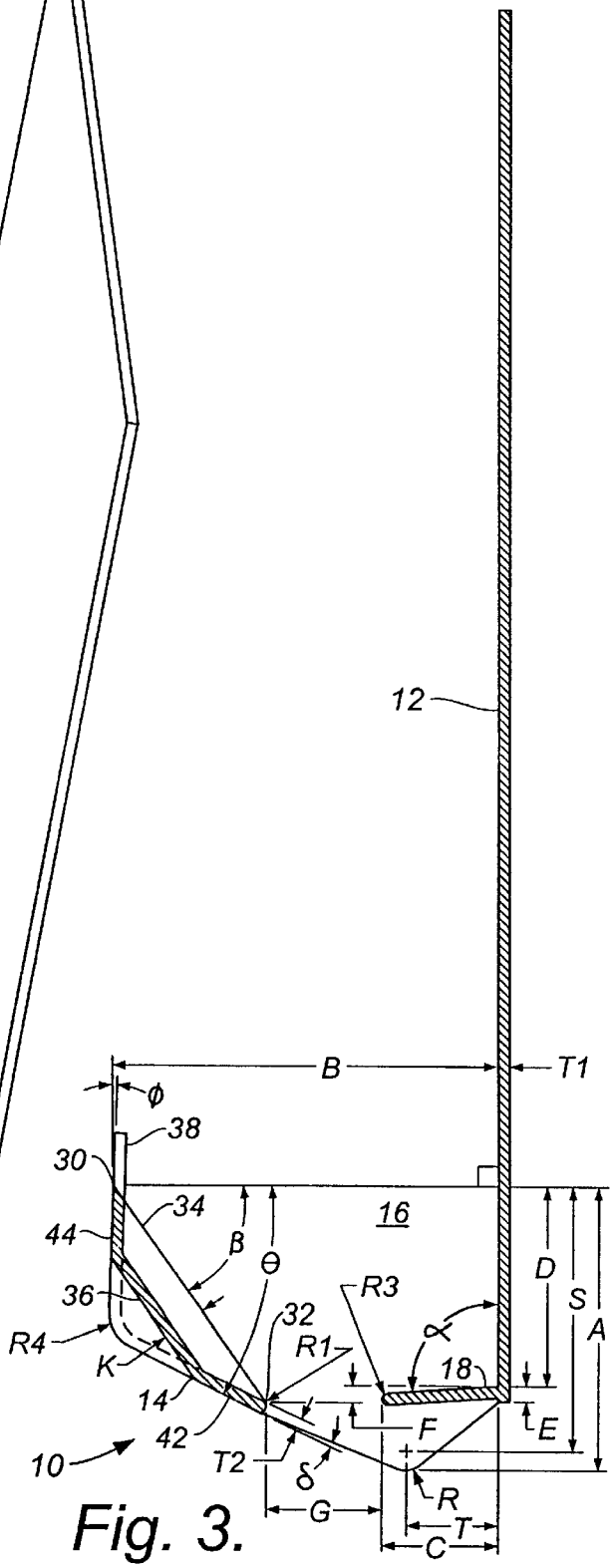
FIG. 3 is a sectional elevational view of the adapter insert of FIG. 1 on line 3—3 of FIG. 2.
Figure 4:
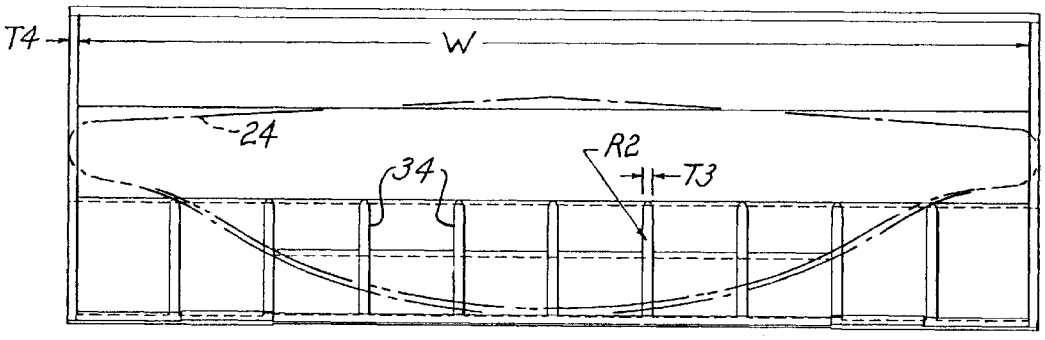
FIG. 4 is a top plan view of the adapter insert of FIG. 1 positioned within an existing towel dispenser.
Figure 2:
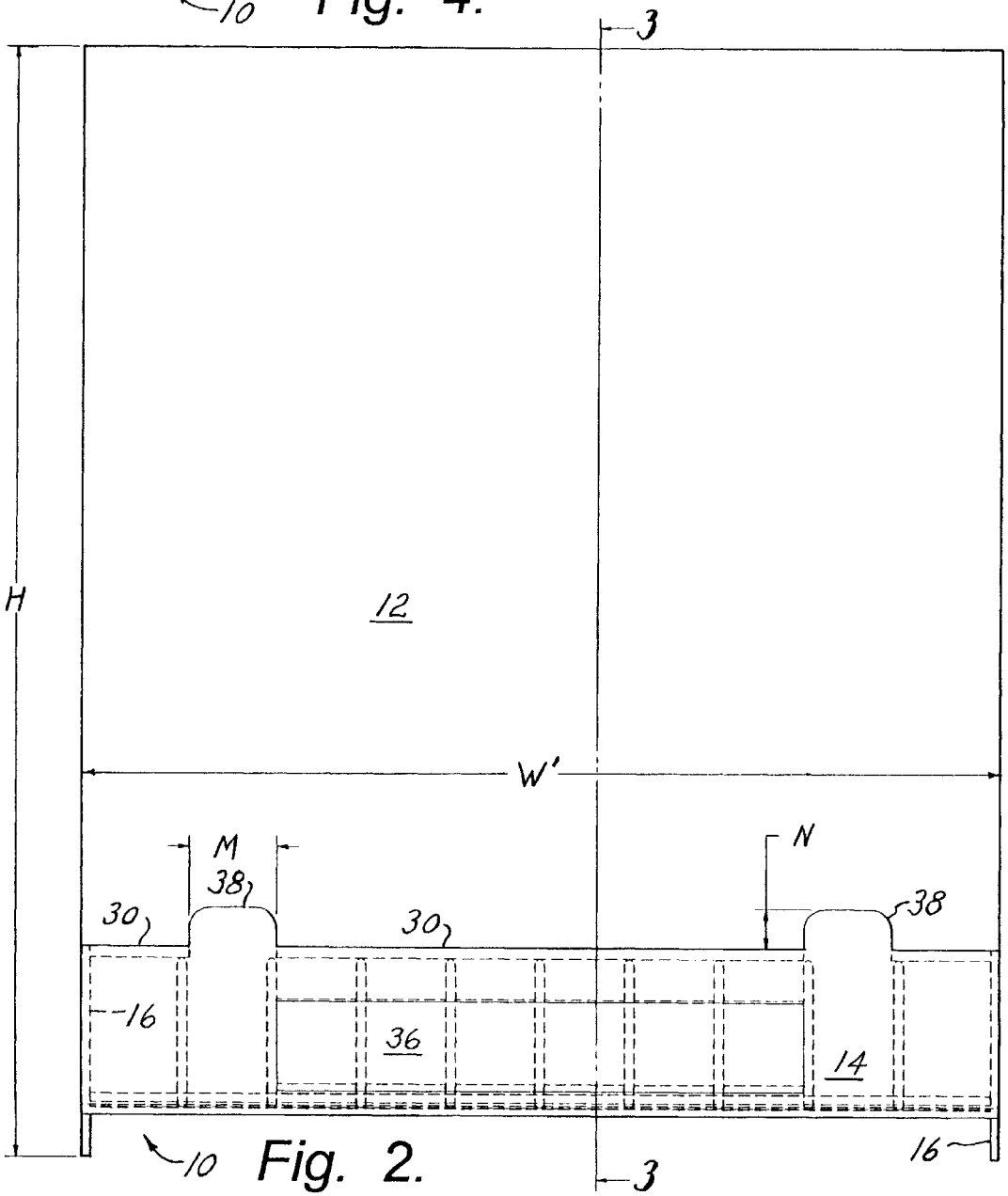
FIG. 2 is a front elevational view of the adapter insert of FIG. 1.
Figure 5:
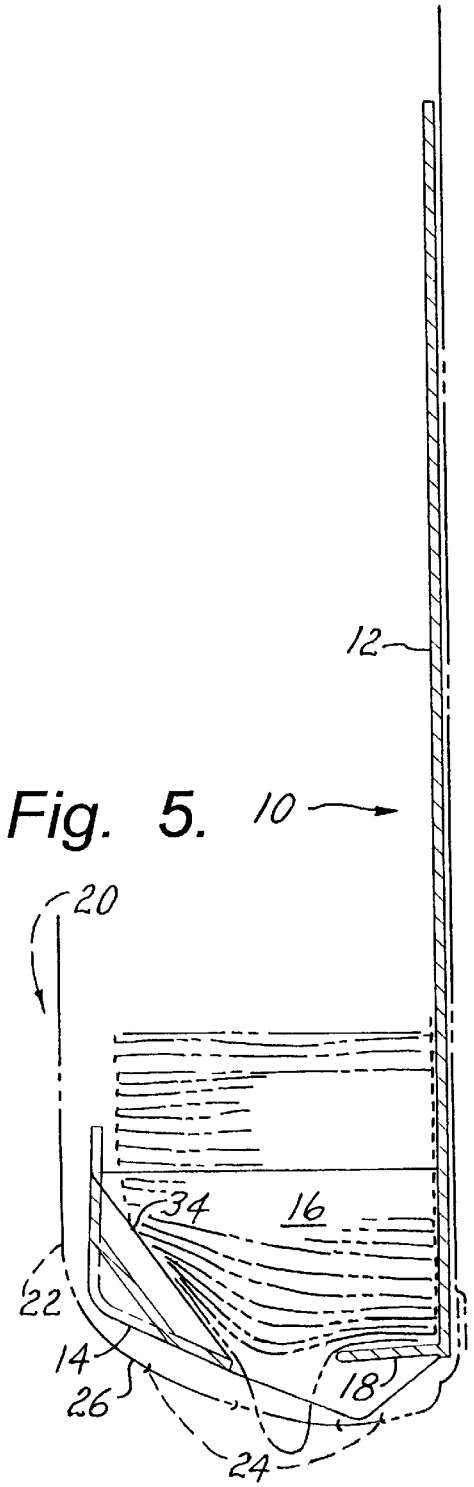
FIG. 5 is a sectional view as in FIG. 3, showing the adapter insert of FIG. 1 in use placed in a sheet dispenser.

The present invention is directed to an adapter insert that is particularly effective for enabling reliable feeding of soft, high-absorbency multifold sheets to be fed from existing paper towel dispensers. With reference to FIGS. 1–6 of the drawings, an adapter insert 10 according to the present invention includes a rear panel portion 12, a front rib portion 14, a pair of side portions 16 that connect the rib portion 14 in spaced relation to the panel portion 12, and a ledge portion 18 that extends forwardly from proximate a lower edge extremity of the panel portion 12. The adapter insert 10 is configured for placement within an existing towel dispenser 20 as shown in FIGS. 4 and 5, the dispenser 20 having an openable housing 22, an outlet opening 24 being formed in a bottom wall 26 of the dispenser 20. Typically in existing dispensers 20 that are configured for feeding single-fold and C-fold towel sheets, the outlet opening 24 is formed as a rounded elongate slot having an enlarged center portion. For example, a single-dashed line in FIG. 4 is representative of the outlet opening 24 of a Series VBC dispenser (including 37VBC01 and 44VBC03)that is available from Bobrick Washroom Equipment Inc. of North Hollywood, Calif., while a double-dashed line represents a corresponding opening of a Series x467 dispenser (including 0467 and 64676) of American Specialties, Inc. of Yonkers, N.Y. Another similar dispenser is available from Alwin Mfg. Co. Inc. of Green Bay, Wis. The Alwin dispenser being marked as being configured according to U.S. Pat. No. 2,830,728. The housings 22 of these dispensers 20 are at least approximately 10.6 inches wide by at least approximately 3.75 inches deep and at least approximately 13 inches high internally. Commercially manufactured multifold towel sheets suitable for use in the above-identified dispensers are available for example, as Selfold #202-04 (multifold) towels from Fort Howard Corporation of Green Bay, Wis., being approximately 9.25 inches long and having a folded width of approximately 3.15 inches. Also available from Fort Howard are Preference ULTRA Absorbent 2-Ply Premium Multifold Towels #210-00, being approximately the same length and width as the #202-04 towels. The ULTRA Absorbent towels are particularly subject to tearing when grasped by wet fingers for feeding from the above dispensers as described above.

In one exemplary configuration, the adapter insert 10 of the present invention has an inside width W, an overall height H, the rib portion 14 sloping upwardly and outwardly to an outer edge extremity 30 at base distance A above bottom extremities of the side portions 16 and a base spacing distance B forwardly of the panel portion 12. The ledge portion 18 extends forwardly to a distance C from the panel portion 12 from a distance D below the edge extremity 30, sloping downwardly at a ledge angle a from the panel portion 12, the panel portion 12 extending downwardly beyond the distance D by a distance E. The rib portion 14 slopes at a rib angle β from a normal to the panel portion 12 (the angle β being measured from upper extremities of the side portions 16, being in line with an upper extremity of the distance D) to an inner edge extremity 32, the inner edge extremity 32 being formed with a lip radius R1 and being located at an offset distance F below the distance D and spaced at a gap distance G forwardly of the ledge portion 18. The bottom extremities of the side portions 16 are formed at a bottom radius R from a distance S below the outer edge extremity of the rib portion 14 and a distance T forwardly of the panel portion 12. The panel portion 12 has a panel thickness T1, and the rib portion 14 has a lip thickness T2 at the inner edge extremity 32, there being a plurality of rib members 34 of thickness T3 extending inwardly at the angle β for smoothly guiding stacked sheets downwardly toward the inner edge extremity 32 of the rib portion 14. The side portions 16 each have a side thickness T4, the adapter insert 10 having an outside width W' that is twice the side thickness T4 greater than the inside width W. Further, the rib members 34 are formed with a rib corner radius R2, the ledge portion 18 also being formed with an edge radius R3. Also, a central portion of the rib portion 14 is formed with a clearance contour 36 at a distance K from opposing edges of the rib members 34 for clearing structure of the above-identified Alwin dispenser that projects within the housing 22 thereof. Moreover, the rib portion 14 is formed with a laterally spaced pair of upwardly extending tab portions 38 for resisting forward displacement of folded sheets when one sheet is being withdrawn from the bottom of the insert 10. Thus the tab portions 38 advantageously resist a condition of several remaining sheets of a stack being dislodged from the ledge portion and falling as a clump from the insert 10. The tab portions 38 each have a width M, extending a distance N above the outer edge extremity 30.

Figure 6:
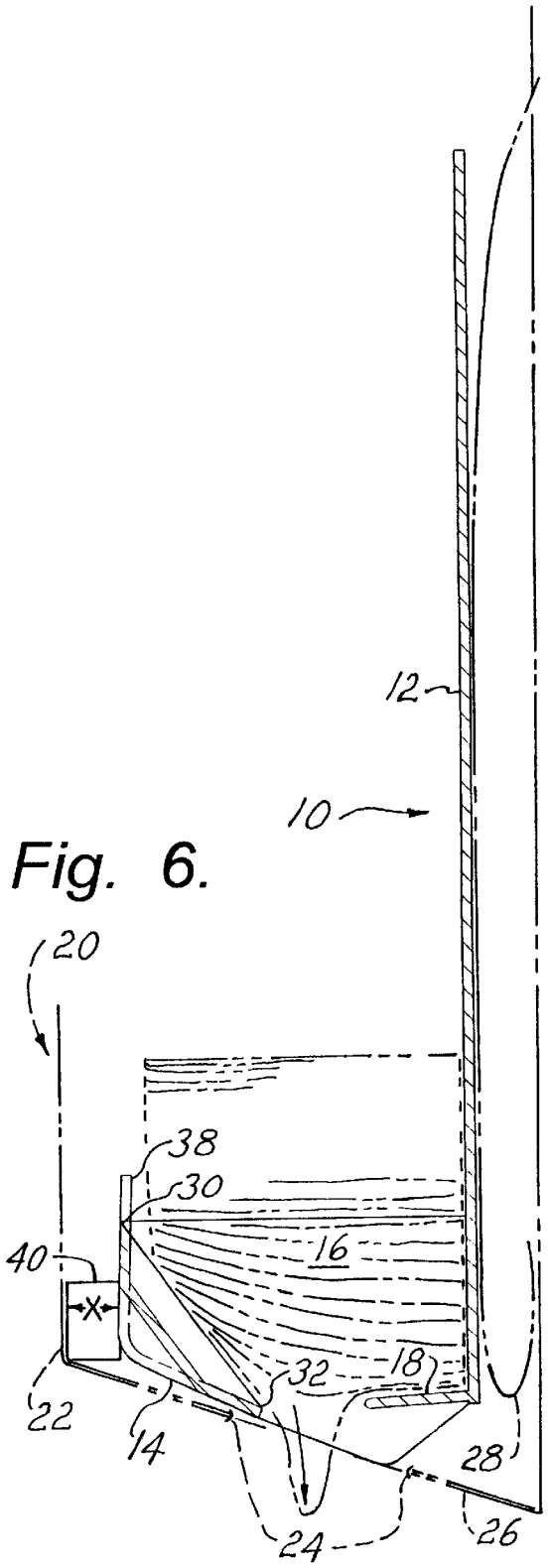
FIG. 6 is a sectional view as in FIG. 5, showing the adapter insert of FIG. 1 in a different sheet dispenser.
Figure 7:
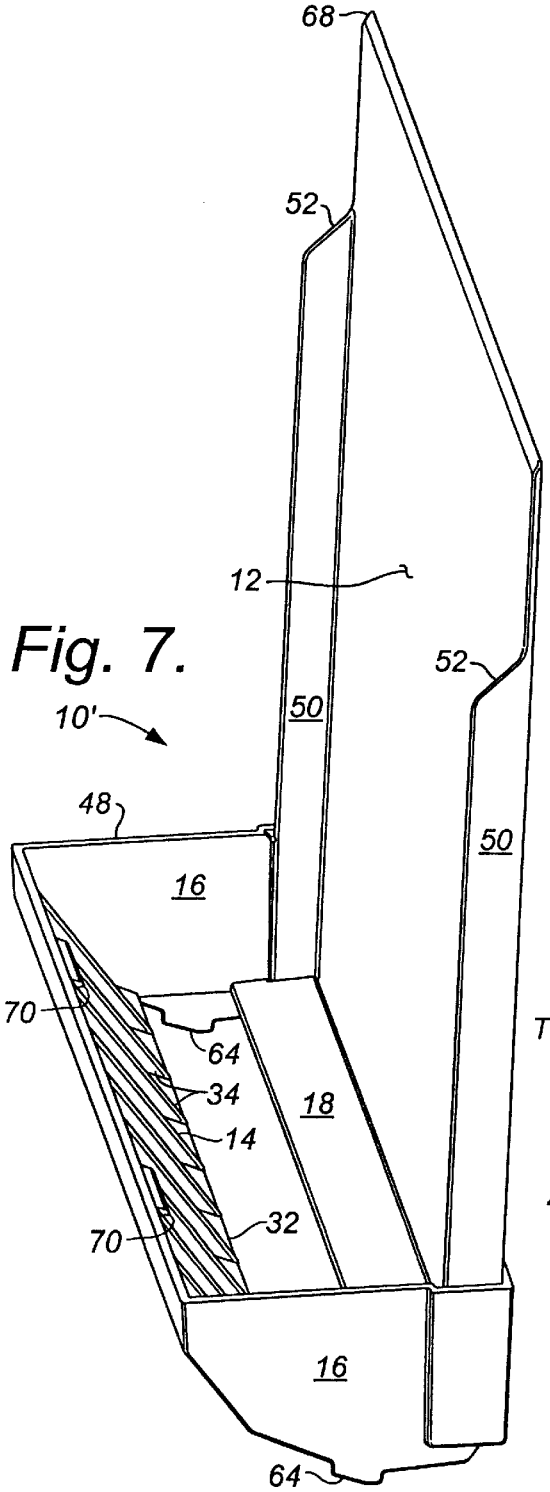
FIG. 7 is a perspective view showing an alternative configuration of the adapter insert of FIG. 1.

As shown in FIG. 6, a spaced pair of spacer blocks 40 can be interposed between the rib portion 14 and front portions of the housing 22 when the adapter insert 12 is positioned within the American Specialty x467 series dispensers 20, the spacers 40 having a thickness X that is selected for suitably compressing a housing spring 28 of that American Specialty dispenser 22 for locating the gap distance G approximately centered over end extremities of the opening 24 as shown in FIG. 5.

An experimental prototype of the adapter insert 10 in the configuration of FIGS. 1–6 has been fabricated and successfully tested, the height H being approximately 12.85 inches, and the width W being approximately 10.3 inches. The distances A and B to the outer edge extremity 30 were approximately 2.457 and 3.316 inches respectively, and the distances C and D of the ledge portion 18 were approximately 0.994 and 1.720 inches respectively, the angles $\alpha$ and $\beta$ being approximately 94 and 54.5 degrees respectively. Also, the distance E to the bottom of the panel portion 12 was approximately 0.134 inch, the distances F and G to the inner edge extremity 32 being approximately 0.168 and 0.994 inch, respectively. The distance K was approximately 0.390 inch, the rib corner radius R2 being approximately 0.050 inch (full radius). The bottom radius R was approximately 0.175 inch, the distances S and T being approximately 2.282 and 0.792 inches respectively. A lower outside contour 42 of the rib portion 14 slopes upwardly and forwardly from the inner edge extremity 32 at an angle $\theta$ from the normal to the panel portion 12, an upper outside contour 44 of the rib portion 14 sloping downwardly and slightly forwardly from the outer edge extremity 30 at an angle $\phi$ from the panel portion 12, the angles $\theta$ and $\phi$ being approximately 26.0 and 2.0 degrees respectively, an outside radius R4 of approximately 0.375 being formed between the angles $\theta$ and $\phi$, respectively. A lower contour portion of the side members 16 between the base radius R and the rib portion 14 makes small break angle $\delta$ of approximately 3.7 degrees with the lower outside contour 42. Finally, the width M and height N of the tab portions 38 are approximately 1.00 and 0.446 inches respectively.

The outside width W' of the experimental prototype adapter insert 10 is thus approximately 10.5 inches, the panel thickness T1 being approximately 0.10 inch, the thicknesses T2, T3, and T4 being approximately 0.10, 0.11, and 0.10 inches respectively. As such, the prototype adapter insert 10 is sufficiently compact to fit within each of the dispensers 20 identified above, the thickness X of the spacer blocks 40 being appropriately approximately 0.38 inch for properly compressing the spring 28 as described above. Feeding of multi-fold sheets was satisfactory and reliable, even when performed using wet fingers, the tests being conducted with #210-00 Preference Ultra 2-Ply Premium Multifold Towels from Fort Howard Corporation, the towels being approximately 9.38 inches long and 3.13 inches in folded width.

Based on the above and other experiments, and with further reference to FIGS. 7–12, an alternative and preferred configuration of the adapter insert, designated 10', is assembled from a tray member 46 and a funnel member 48, the tray member 46 including a counterpart of the panel portion 12, the funnel member 48 including counterparts of the rib portion 14, the side portions 16, and the ledge portion 18. The form and dimensions of the insert 10' conform to that of the insert 10 as described above except as described herein. The tray member 46 has respective flange portions 50 that extend forwardly from opposite side extremities of the panel portion 12, the flange portions 50 also extending from proximate the bottom of the panel portion 12 to a major portion of the height thereof for structurally reinforcing the tray member 46 and guiding the towels. Upper extremities of the flange portions 50 are formed with smoothly blended ramps 52 for guiding upper portions of a stack of sheets or towels into alignment between the flange portions 50, and for avoiding bending stress concentrations in the tray member 46.

Figure 10:
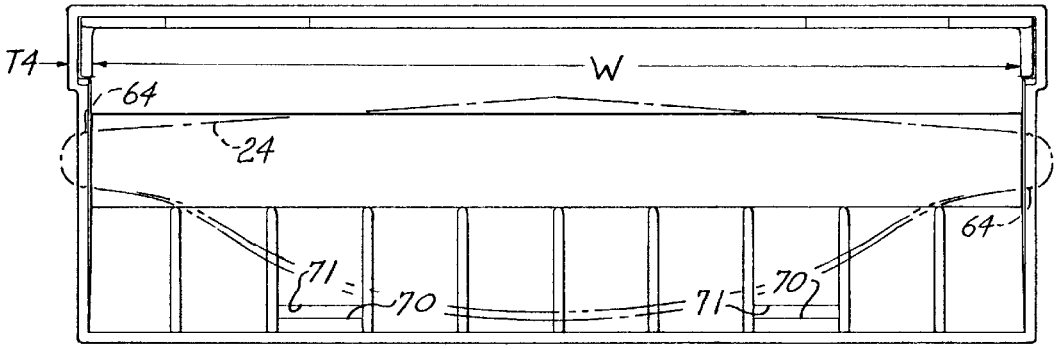
FIG. 10 is a plan view as in FIG. 4, showing the adapter insert of FIG. 7 positioned within an existing towel dispenser.
Figure 9:
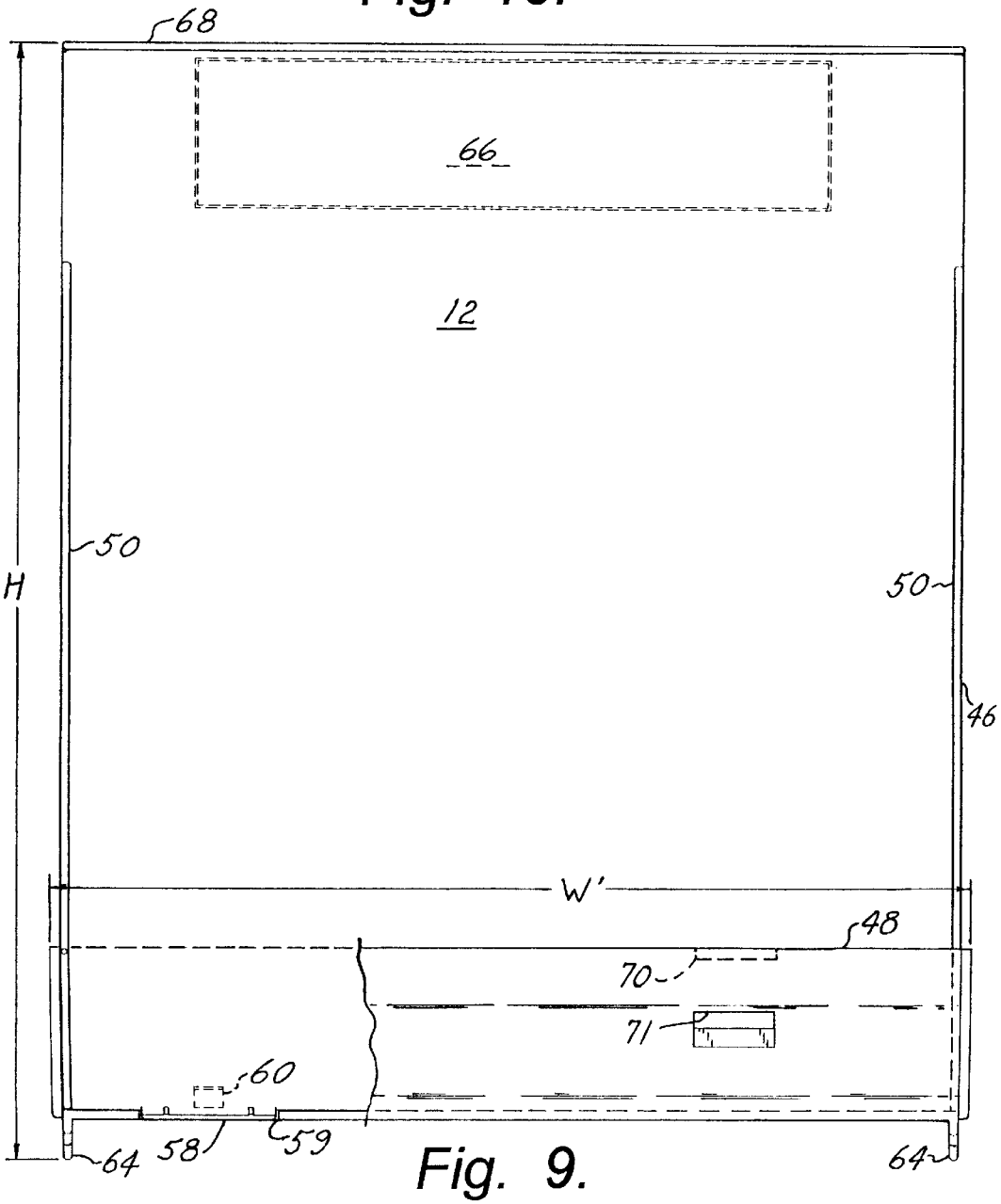
FIG. 9 is a front elevational view of the adapter insert of FIG. 7.
Figure 11:
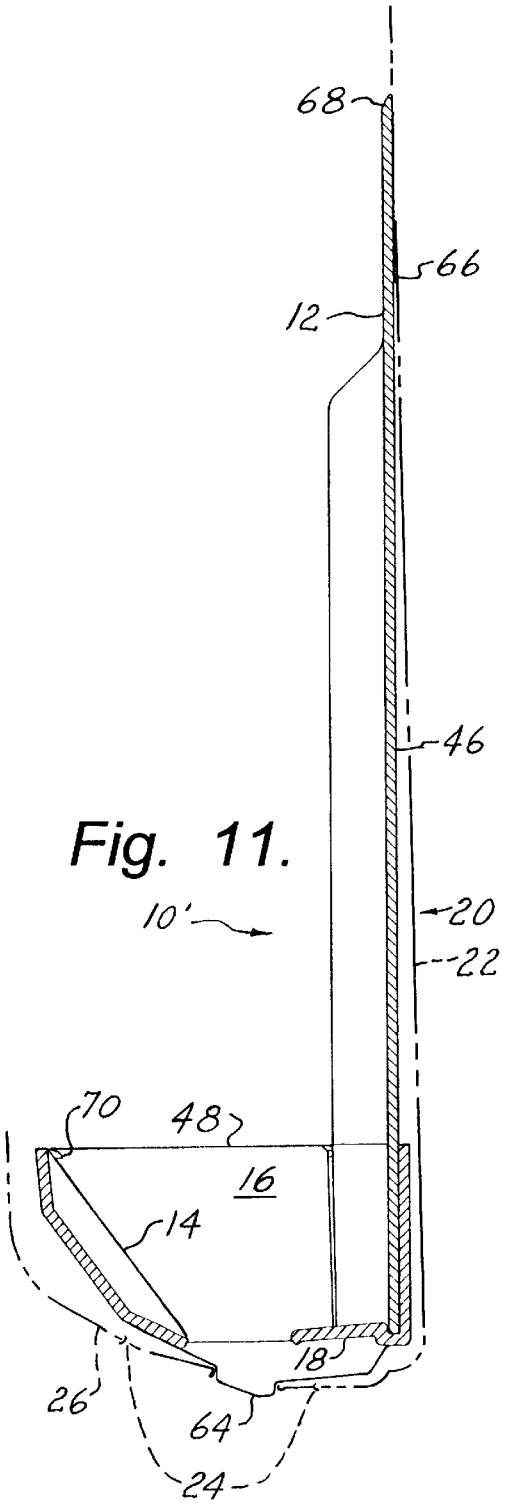
FIG. 11 is a sectional view as in FIG. 8, showing the adapter insert of FIG. 7 in use placed in a sheet dispenser.

The funnel member 48 includes counterparts of the rib portions 14, the side portions 16, the ledge portion 18, and a rear portion 54, the rear portion 54 and the side portions 16 being formed for fixedly engaging a bottom portion of the tray member 46. More particularly, rear portions of the side portions 16 are offset outwardly to form respective channels 56 that receive bottom extremities of the flange portions 50, inside surfaces of the flange portions 50 and the remainder of the side portions being proximately flush as best shown in FIG. 10. A pair of downwardly projecting tabs 58 are formed in a bottom edge extremity of the panel portion 12 for interlocking engagement with corresponding openings 59 of the funnel member 48, each of the tabs 58 having a detent 60 projecting rearwardly therefrom for snap engagement with the corresponding opening 59. The funnel member 48 is formed for engaging inside surfaces of the panel portion 12 and the flange portions 50 at respective bottom extremities thereof as indicated at trough 61. Also, the flange portions 50 have respective front-facing protuberances 62 formed thereon for engaging the respective channels 56 proximate upper extremities thereof, the combination of the rear portion 54, the channels 56, the tabs 58, the detents 60, the trough 61, and the protuberances 62 providing a rigid snap-together connection of the tray member 46 and the funnel member 48.

Figure 8:
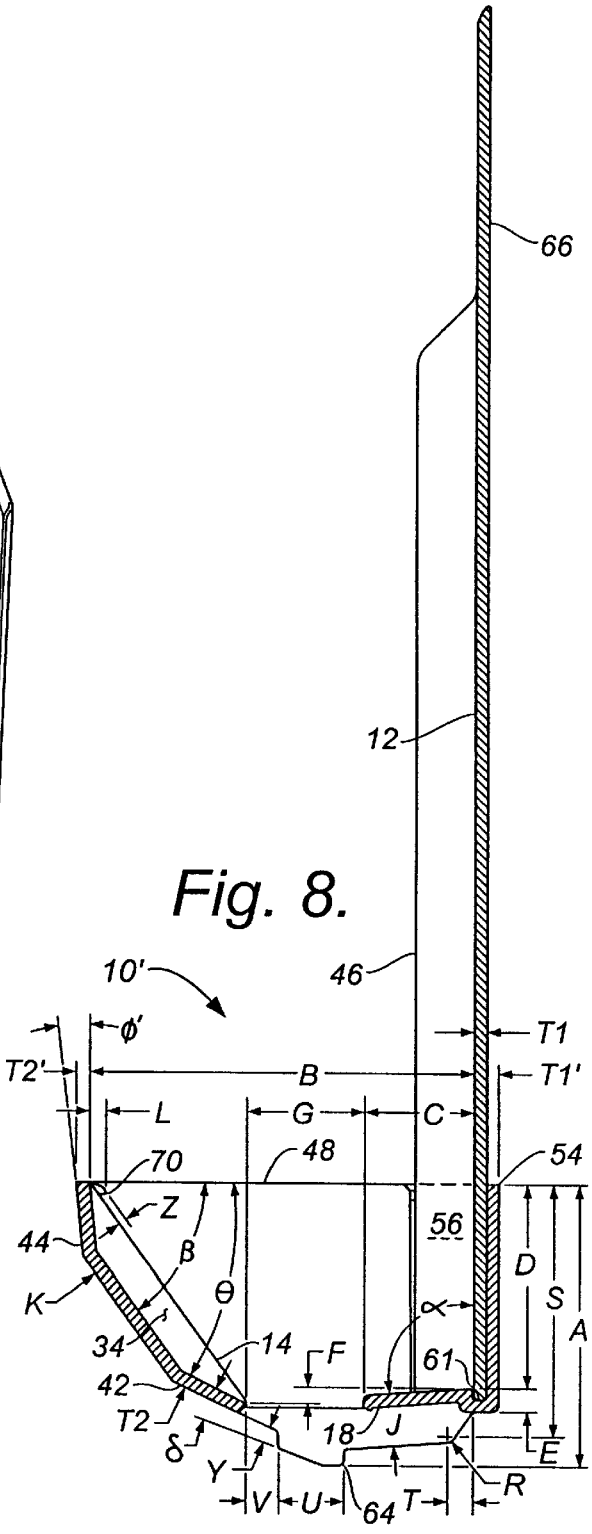
FIG. 8 is a sectional view as in FIG. 3, showing the adapter insert of FIG. 7.

In another and important preferred aspect, the adapter insert 10' incorporates a pair of downwardly projecting leg portions 64 for registration of the rib portion 14 and the ledge portion 18 relative to the dispenser opening 24, especially with respect to forward and/or rearward movement of the funnel member 48. As shown in Figs, 7–12, the leg portions 64 form lower tab-shaped extremities of the side walls 16, each leg portion 64 having a width U in the plane of the side wall, and being offset a distance V rearwardly of the inner edge extremity 32 of the rib portion 14. The width U is approximately 0.55 inch and the offset V is approximately 0.27 inch, the width W between the side wall portions being approximately 9.73 inches. Thus the leg portions 64 are located for engaging the opening 24 proximate opposite ends thereof, each of the leg portions 64 also being configured for registering the funnel member 48 against forward and rearward movement by engaging opposite sides of the opening 24. The leg portions 64 are further effective for registering the adapter insert 10' approximately centered laterally within the dispenser 20 by being spaced only slightly within opposite ends of the opening 24. Thus the leg portions 64 obviate the need for the spacer blocks 40 in the dispenser 20 of FIG. 6. In FIG. 8, the base height A is inclusive of the leg portions 64, front portions of the leg portions 64 being foreshortened at the break angle δ to a distance Y forwardly and downwardly from intersecting with an extension of the lower outside contour 42 of the rib portion 14, the dimension Y being taken at the offset distance V rearwardly of the inner edge extremity 32. Rearwardly of the leg portions 64, the side portions 16 extend at a distance J below the top surface of the ledge portion 18 (parallel thereto), to a counterpart of the base radius R.

The adapter insert 10' extends rearwardly from the front of the panel portion 12 by a counterpart of the panel thickness, designated T1', being inclusive of the rear portion 54 of the rib member 48. Also, the rib portion 14 of the funnel member 48 is formed with the lip thickness T2 extending uniformly to a corresponding front thickness T2' at the top front of the funnel member 48. Further, the upper outside surface 44 of the rib portion 14 slopes downwardly and rearwardly at a convergence angle ϕ' (oppositely from the divergence angle ϕ of FIG. 3), the clearance contour at the distance K extending uniformly between the side portions 16.

The tray member 46 is provided with an adhesive patch 66 on the rear of the panel portion 12 for holding an upper extremity 68 of the panel portion 12 against a rear inside surface of the dispenser housing 22, the upper extremity 68 also being beveled for smooth passage of sheets when stacked higher than the upper extremity 68.

An additional and important preferred feature of the adapter insert 10' is that a pair of hook members 70 are formed proximate the upper extremity of the rib portion 14 for preventing a remnant of a few sheets from falling through the funnel member 48, the hook members 70 being spaced between the side portions 16 of the funnel member 48. More particularly, it has been discovered that when only a few sheets remain stacked within the adapter 10, the act of dispensing one sheet tends to displace the front of the stack remnant upwardly and, if the displacement is sufficient to bring the rear of the stack forwardly of the ledge portion 18, multiple sheets are subject to falling as a clump from the dispenser 20. Each hook member 70 extends rearwardly to a length L between upper extremities of adjacent rib members 34, and protruding to a hook offset Z within the angle β, the bottom of the hook members 70 being located more closely spaced from the ledge portion 18 than the width of the sheets being dispensed. Thus the stack remnant is prevented by the hook members 70 from shifting forwardly far enough to slip from the ledge portion 18, thereby to provide shingle-sheet dispensing of an entire stack of the sheets.

In an exemplary and preferred implementation of the insert device 10', the height H is approximately 12.58 inches, the distances A and B to upper extremities of the rib members are approximately 2.410 and 3.246 inches respectively, and the distances C and D of the ledge portion 18 are approximately 0.943 and 1.735 inches respectively, the angles α and β being approximately 94.5 and 54.5 degrees respectively. Also, the distance E to the outside of the funnel member below the panel portion 12 is approximately 0.210 inch, the distances F and G to the inner edge extremity 32 being approximately 0.137 and 0.985 inch, respectively. The distance K is approximately 0.411 inch, the rib corner radius R2 being approximately 0.040 inch. The bottom radius R was approximately 0.062 inch, the distances S and T being approximately 2.151 and 0.215 inches respectively. The angles θ and ϕ' are approximately 26.0 and 5.0 degrees respectively, the angle δ also being approximately 5.0 degrees. The distance J to the bottom of the side portions 16 is approximately 0.464 inch, and the break offset Y is approximately 0.130 inch. The leg width U is approximately 0.550 inch, and the offset V of the leg portions 64 is approximately 0.271 inch. The length L of the hook members 70 is approximately 0.148 inch, and the offset Z is approximately 0.062 inch. The inside width W is approximately 9.721 inches, and the outside width W' is approximately 10.25 inches, the panel thickness T1 being approximately 0.10 inch, the thicknesses T1', T2, and T4 being approximately 0.210, 0.11, and 0.265 inches respectively. Some variations in the above dimensions are of course contemplated. For example, the dimension B can be between approximately 3.125 inches (the folded width of the sheets) and approximately 3.400 inches, the ledge depth D being between approximately 1.635 inches and approximately 1.835 inches, and the gap distance G being between approximately 0.80 and approximately 1.20 inch. The angle α can be between approximately 90° and 100°, and the angle β can be between approximately 50° and 60°. The tray member 46 and the funnel member 48 can be formed of any suitable rigid material, such as molded plastic. The formation of the hook members 70 is facilitated by corresponding cored front wall openings 71 that are formed in the rib portion 14.

Figure 12:
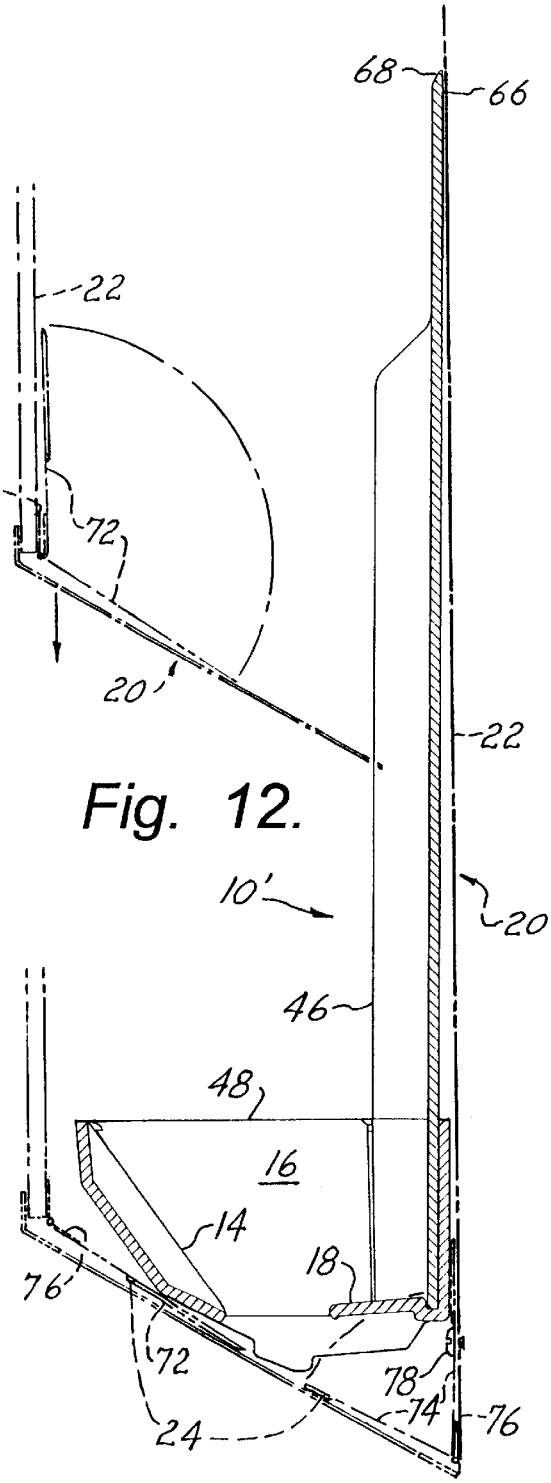
FIG. 12 is a sectional view as in FIG. 11, showing the adapter insert of FIG. 7 in a different sheet dispenser.

With particular reference to FIG. 12, another dispenser of the prior art, designated 20', has the opening 24 defined by respective front and rear door members 72 and 74 for permitting bottom loading of stacked sheets. The door members 72 and 74 are mounted to the housing 22 by respective spring-loaded hinges 76 for biasing toward coplanar closed positions thereof as depicted by dashed lines at the bottom of FIG. 12. According to the present invention, the rear door member 74 is held in an open position against a vertical rear wall of the housing 22 by a screw fastener 78. Loading of the adapter insert 10' is completed by holding the front door member 72 in an open position facing proximate a front wall surface of the housing as shown by dashed lines in an upper portion of FIG. 12; feeding the insert 10' (with sheets stacked therein) upwardly between the door members 72 and 74 and into the housing as indicated by the downward arrow in FIG. 12; releasing the front door member 72 for moving same to the closed position thereof; and lowering the insert 10' within the housing into supportive engagement by the front door member 72.

Although the present invention has been described in considerable detail with reference to certain preferred versions thereof, other versions are possible. For example, the leg portions 64 can be formed as outwardly projecting ribs on the rib portion 14 and/or the shelf portion 18. Also, or in the alternative, additional outwardly projecting ribs can be formed elsewhere on the funnel member 48 for contacting interior surfaces of the housing 22 of in particular configurations of the dispenser 20. Further, the flange portions 50, leg portions 64, the adhesive patch 66, and the hook members 70, or any combination thereof, can be included in the insert device 10 of FIGS. 1–6. Therefore, the spirit and scope of the appended claims should not necessarily be limited to the description of the preferred versions contained herein.

What is claimed is:

1. An adapter insert device for a sheet dispenser having a housing for receiving a stack of folded sheets, the housing having a bottom opening, the bottom opening being formed as a rounded elongate slot having an enlarged center portion, the insert device comprising:

(a) a rear panel portion;

(b) a front ramp portion;

(c) a pair of side panel portions connecting opposite ends of the front ramp portion and corresponding lower side edge portions of the rear panel portion; and (d) a ledge portion extending forwardly from the rear panel portion in a direction intersecting the ramp portion proximate a bottom extremity thereof, the device being formed for placement in the dispenser with the side panel portions extending above and proximate opposite ends of the bottom opening, portions of the ramp and ledge portions extending in vertically spaced relation over opposite sides of the enlarged center portion of the opening, wherein the ramp portion is spaced from the ledge portion, extending downwardly and rearwardly from a location vertically displaced above the ledge portion, the sheets being dispensed by being withdrawn between the ramp portion and the ledge portion and through the bottom opening.

2. The insert device of claim 1, further comprising an adhesive member affixed to a rear surface of the rear panel portion for holding an upper extremity of the panel portion proximate an inside surface of the dispenser.

3. The insert device of claim 1, wherein the ledge portion projects to a distance C from the rear panel portion, and the front ramp portion has an inner extremity that is spaced forwardly of the ledge member by a distance G, the distance G being approximately equal to the distance C.

4. The insert device of claim 3, wherein the inner extremity of the ramp portion is spaced below an upper surface of the ledge portion by a distance F, the distance F being between approximately 10 percent and approximately 30 percent of the distance G.

5. The insert device of claim 4, wherein the distance F is approximately 13.5 percent of the distance G.

6. The insert device of claim 3, wherein the ramp portion slopes upwardly and forwardly from the inner extremity at an angle β from being normal to the rear panel portion, the angle β being from approximately 50 degrees to approximately 60 degrees.

7. The insert device of claim 6, wherein the angle β is approximately 54.5 degrees.

8. The insert device of claim 6, wherein the ledge portion slopes downwardly and forwardly from the rear panel portion not more than approximately 10 degrees.

9. The insert device of claim 8, wherein the ledge portion slopes at an angle of approximately 94 degrees from the rear panel portion.

10. An adapter insert device for a sheet dispenser having a housing for receiving a stack of folded sheets, the housing having a bottom opening, the bottom opening being formed as a rounded elongate slot having an enlarged center portion, the insert device comprising:

(a) a rear panel portion;

(b) a front ramp portion;

(c) a pair of side Panel portions connecting opposite ends of the front ramp portion and corresponding lower side edge portions of the rear panel portion;

(d) a ledge portion extending forwardly from the rear panel portion toward and spaced from the ramp portion, the device being formed for placement in the dispenser with the side panel portions extending above and proximate opposite ends of the bottom opening, portions of the ramp and ledge portions extending in vertically spaced relation over opposite sides of the enlarged center portion of the opening, the sheets being dispensed by being withdrawn between the ramp portion and the ledge portion and through the bottom opening; and (e) a downwardly projecting leg portion, the leg portion extending vertically below the ramp and ledge portions for engaging the bottom opening of the housing for registration of the device forwardly and/or rearwardly relative to the opening.

11. The insert device of claim 10, wherein the leg portion projects from one of the side panel portions for engaging the opening proximate an end extremity thereof.

12. The insert device of claim 10, wherein the leg portion is one of a spaced pair of the leg portions for engaging opposite locations of the opening.

13. The insert device of claim 12, wherein the leg portions extend from corresponding ones of the side panel portions for engaging the opening proximate opposite end extremities thereof.

14. The insert device of claim 10, further comprising an adhesive member affixed to a rear surface of the rear panel portion for holding an upper extremity of the rear panel portion proximate an inside surface of the dispenser.

15. In a sheet dispenser having a housing for receiving a stack of folded sheets, the housing having a bottom opening, the bottom opening being formed as a rounded elongate slot having an enlarged center portion, the improvement comprising an insert device having:

(a) a rear panel portion;

(b) a front ramp portion, the ramp portion sloping upwardly and forwardly from an inner extremity thereof;

(c) a pair of side panel portions connecting opposite ends of the front ramp portion and corresponding lower side edge portions of the rear panel portion; and (d) a ledge portion located below an upper extremity of the ramp portion and in spaced relation thereto, the ledge portion extending forwardly from the panel portion in a direction intersecting the ramp portion proximate a bottom extremity thereof.

16. In the sheet dispenser of claim 15 having a forwardly biased spring member within the housing, the further improvement comprising a spacer compressively located between a front surface of the insert device and an interior surface of the housing, the spacer in combination with the device rearwardly displacing the spring member for locating a forward extremity of the ledge portion and a rearward extremity of the ramp portion approximately centered over the elongate slot.

17. In the sheet dispenser of claim 15 having a forwardly biased spring member within the housing, the further improvement comprising a registration member of the device rigidly projecting into the opening and engaging same for rearwardly displacing the spring member to locate a forward extremity of the ledge portion and a rearward extremity of the ramp portion approximately centered over the elongate slot.

18. The insert device of claim 15, wherein the ramp portion has an inclination of between 50 and 60 degrees from a perpendicular to the rear panel portion, the ledge portion sloping downwardly up to 10 degrees from being perpendicular with the rear panel portion.

19. The insert device of claim 15, further comprising a parallel spaced plurality of rib members oriented perpendicular to the rear panel portion, each rib member having a smoothly rounded edge margin, the edge margins of the rib members collectively defining a ramp surface for smoothly guiding the sheets.

20. The insert device of claim 15, further comprising a hook member extending inwardly from proximate an upper extremity of the ramp portion for resisting upward movement of sheets on the ramp portion.

21. A method for feeding multifold towel sheets from an existing dispenser having a housing, a bottom opening in the housing being a rounded elongate slot having an enlarged center portion, the existing dispenser being adapted for feeding single-fold and/or C-fold sheets, the method comprising the steps of:

(a) providing an insert device having a rear panel portion, a front ramp portion that slopes upwardly and forwardly from an inner extremity thereof, a pair of side panel portions that connect opposite ends of the front ramp portion to corresponding lower side edge portions of the rear panel portion, and a ledge portion located below an upper extremity of the ramp portion and in spaced relation thereto, the ledge portion extending forwardly from the rear panel portion in a direction intersecting the ramp portion proximate a bottom extremity thereof;

(b) inserting the device into the housing with the ramp portion and the ledge portion extending over opposite sides of the enlarged center portion of the bottom opening;

(c) loading a stack of multi-folded sheets into the device with the stack being supported on the ramp portion and the ledge portion; and (d) pulling sheets downwardly from between the ramp portion and the ledge portion and through the bottom opening.

22. The method of claim 21, wherein the step of inserting the device comprises the further step of interposing a spacer between a front surface of the device and an interior surface of the housing thereby to displace the device sufficiently rearwardly for alignment with the bottom opening of the dispenser.

23. The method of claim 21, wherein the step of inserting the device comprises the further step of engaging a registration member of the device with the opening of the housing thereby to locate the device with a forward extremity of the ledge portion and a rearward extremity of the ramp portion approximately centered over the elongate slot of the dispenser.

24. A method for feeding multifold towel sheets from an existing dispenser having a housing, a bottom opening in the housing being a rounded elongate slot having an enlarged center portion, front and rear portions of the bottom opening being defined by respective front and rear door members in respective closed positions thereof, the existing dispenser being adapted for feeding single-fold and/or C-fold sheets, the door members being pivotable upwardly within the housing for receiving the stack of multi-folded sheets from below the housing, the method comprising the steps of:

(a) providing an insert device having a rear panel portion, a front ramp portion that slopes upwardly and forwardly from an inner extremity thereof, a pair of side panel portions that connect opposite ends of the front ramp portion to corresponding lower side edge portions of the rear panel portion, and a ledge portion extending forwardly from the rear panel portion toward the ramp portion;

(b) loading a stack of multi-folded sheets into the device with the stack being supported on the ramp portion and the ledge portion; and (c) inserting the device into the housing with the ramp portion and the ledge portion extending over opposite sides of the enlarged center portion of the bottom opening, comprising the further steps of:

(i) fastening one of the door members in an open position facing proximate a vertical interior surface of the housing;

(ii) holding the other of the door members in an open position facing proximate another interior surface of the housing;

(iii) feeding the device between the door members and into the housing;

(iv) moving the other of the door members to the closed position thereof; and (v) moving the device within the housing into supportive engagement by the other of the door members; and (d) pulling sheets downwardly from between the ramp portion and the ledge portion and through the bottom opening, wherein the loading step precedes the feeding step.

25. An adapter insert device for a sheet dispenser having a housing for receiving a stack of folded sheets, the housing having a bottom opening, the bottom opening being formed as a rounded elongate slot having an enlarged center portion, the insert device comprising:

(a) a rear panel portion;

(b) a front rib portion including a plurality of rib members oriented perpendicular to the rear panel portion, each rib member having a smoothly rounded edge margin, the edge margins of the rib members collectively defining a ramp surface for smoothly guiding the sheets;

(c) a pair of side panel portions connecting opposite ends of the front rib portion and corresponding lower side edge portions of the rear panel portion; and (d) a ledge portion extending forwardly from the rear panel portion toward and spaced from the ramp surface, the device being formed for placement in the dispenser with the side panel portions extending above and proximate opposite ends of the bottom opening, portions of the ramp and ledge portions extending in vertically spaced relation over opposite sides of the enlarged center portion of the opening, the sheets being dispensed by being withdrawn between the ramp portion and the ledge portion and through the bottom opening.

* * * * *